US006254791B1

(12) United States Patent
Boyd

(10) Patent No.: US 6,254,791 B1
(45) Date of Patent: Jul. 3, 2001

(54) MULTICOLORED CONTROL PANEL

(75) Inventor: James W. Boyd, New Berlin, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 09/253,242

(22) Filed: Feb. 19, 1999

(51) Int. Cl.[7] ..... H05B 33/10

(52) U.S. Cl. ..... 216/4; 216/24; 216/65; 216/95; 156/99; 156/250; 156/252; 156/272.2; 156/293; 156/513; 362/330; 362/333; 362/339

(58) Field of Search ..... 216/4, 95, 65, 216/24; 156/99, 250, 252, 272.2, 293, 513; 362/330, 333, 339

(56) References Cited

U.S. PATENT DOCUMENTS 4,862,613 * 9/1989 Eyngrn ..... 40/546
5,456,955 * 10/1995 Muggli ..... 427/555
5,723,843 * 3/1998 Muggli ..... 219/121.69
5,916,450 * 6/1999 Muggli et al. ..... 216/4

* cited by examiner

*Primary Examiner*—Randy Gulakowski
*Assistant Examiner*—Michael Kornakov
(74) *Attorney, Agent, or Firm*—James Earl Lowe, Jr.

(57) ABSTRACT

A method of making an illuminate, multicolored panel, comprising the steps of fixing together an opaque layer to a clear layer to form a panel, etching a well into the opaque layer of the panel, and depositing tinted translucent material into the well.

6 Claims, 2 Drawing Sheets

MULTICOLORED CONTROL PANEL

BACKGROUND OF THE INVENTION

This invention relates to methods for making multicolored panels, and, more particularly, to a method of making multicolored control panels used on control consoles in an operator's cab, such as on a blasthole drill.

It is desirable to have multiple colors on a control panel to help the operator with control recognition. Current control panels are made using two different types of processes. One is a silk screening process which enables a designer to create a multicolored control panel. The designer starts with a clear panel. An appropriate silk screen is then selected to produce the desired colors in the desired locations on the clear panel. The inks used in this process can be chosen to allow light to pass through for back lighting. The more colors the designer adds, the higher the cost. With this method, a finalized design will be released for tooling and templates to be made. This method does not allow for further changes without paying to have new tooling and templates made. Therefore, any control changes or single specials, options, or the like will force the designer to buy more tooling and templates for each new design. Lead times for this process change is normally 6–10 weeks. Because many equipment control panels may include special control panel changes, adding color to a control panel using this method is not practical. Further, silk screening produces a relative thin layer of color, and is normally done on a relative thin clear panel.

The second method for manufacturing nameplates is to engrave the panel using an electronic file from the designer and a CNC engraving machine. With this method, the designer can rapidly make changes to his design without incurring any tooling or template change costs. These panels consist of the panels base color and a clear engraved area. The clear engraved area allows for back lighting the panel, however, this method doesn't allow the designer to add color to the engraved area on the panel.

SUMMARY OF THE INVENTION

This invention provides a method of making a multicolored panel, comprising the steps of fixing together an opaque layer to a clear layer to form a panel, etching a well into the opaque layer of the panel, and depositing tinted material into the well.

More particularly, this invention provides a method of making an illuminate, multicolored panel, comprising the steps of fixing together a thin opaque layer to a thicker clear layer to form a panel, etching a well into the opaque layer of the panel so that all of the opaque material in the well is removed, depositing tinted epoxy into the well to fill the well, etching a second well into the opaque layer of the panel so that all of the opaque material in the well is removed, and illuminating more than one of the wells from the opaque side of the panel.

One of the objects of the invention is the provision of a multicolored control panel which is thicker than in the prior art, and thus more durable.

Another of the objects of the invention is to more easily permit multiple colors to be used, and to allow for quick changes in the control panel's design.

Figure 1:
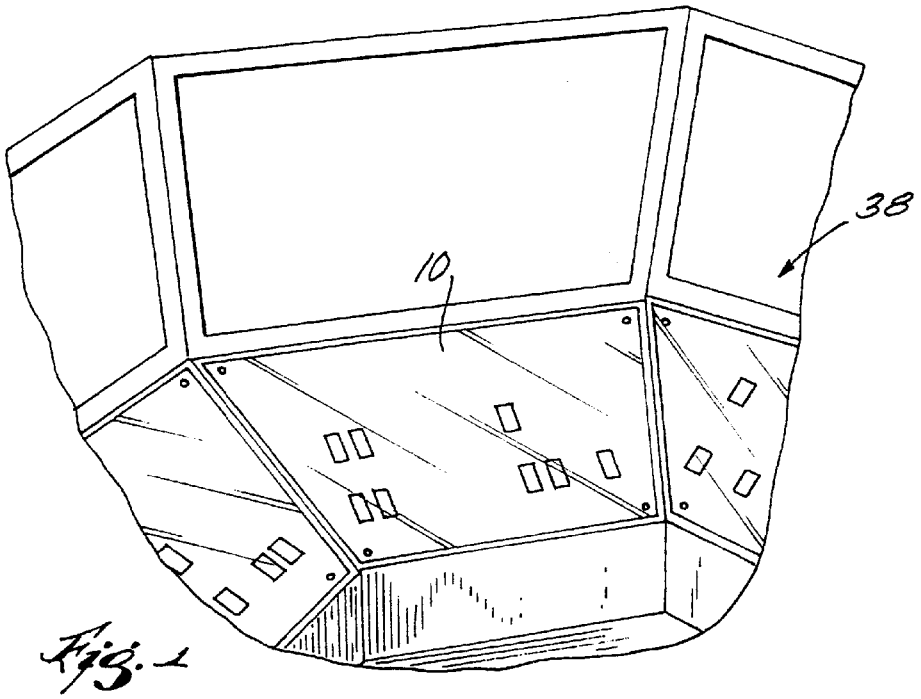
FIG. 1 is a top plan view of the inside of a blasthole drill operator's cab including a multicolored control panel which embodies the invention.
Figure 2:
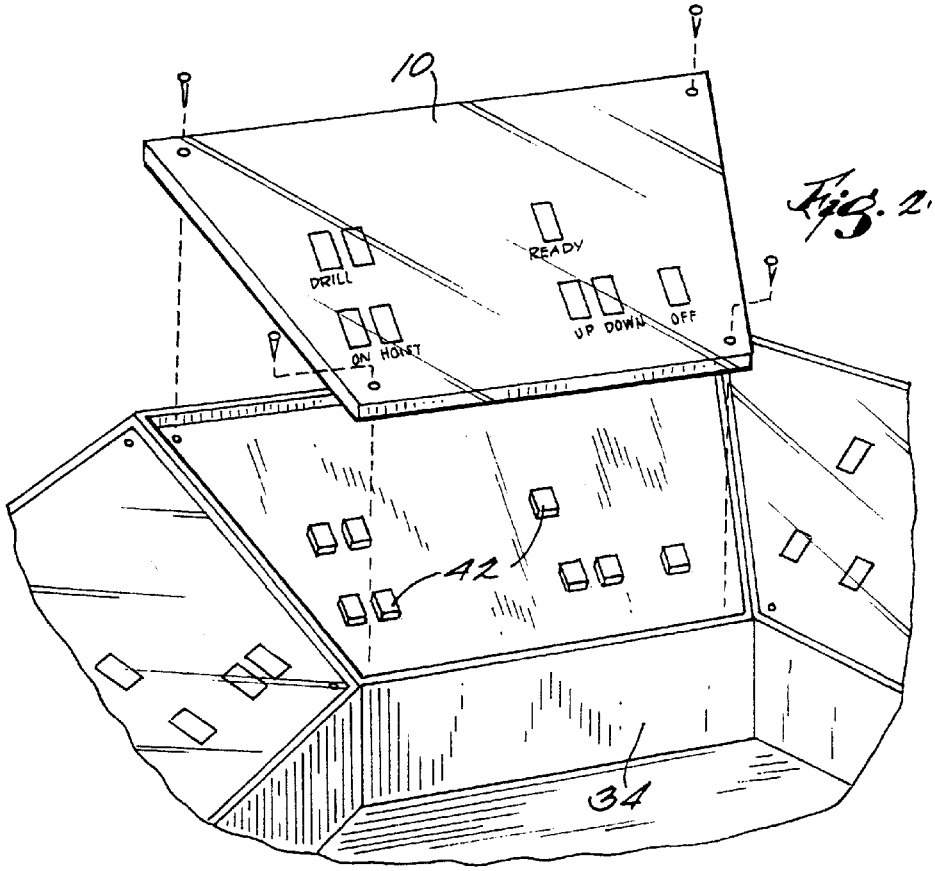
FIG. 2 illustrates how the panel is placed in the cab over various light sources.
Figure 3:
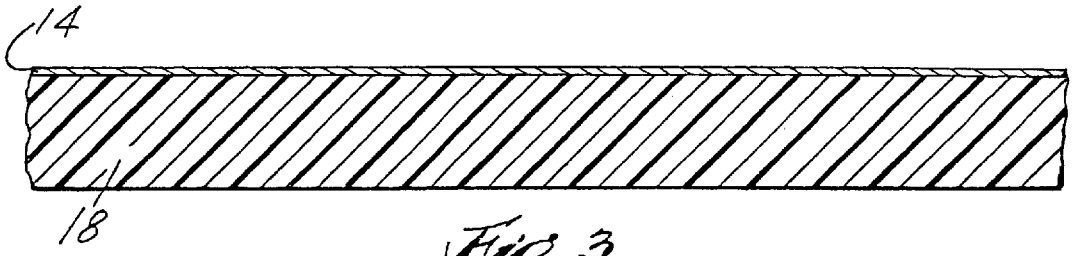
FIG. 3 is a cross sectional view of a portion of the two layer panel.
Figure 4:
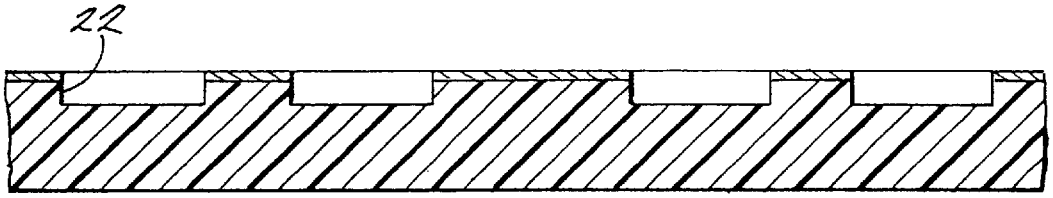
FIG. 4 is a view similar to FIG. 3 showing the panel of FIG. 1 after wells have been etched into the panel.
Figure 5:
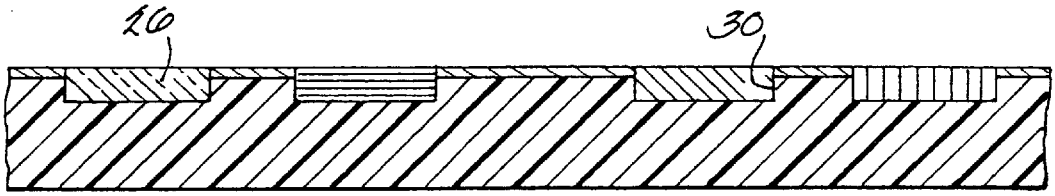
FIG. 5 is a view similar to FIG. 3 showing the panel of FIG. 4 after at least some of the wells have been filled with colored epoxy.
Figure 6:
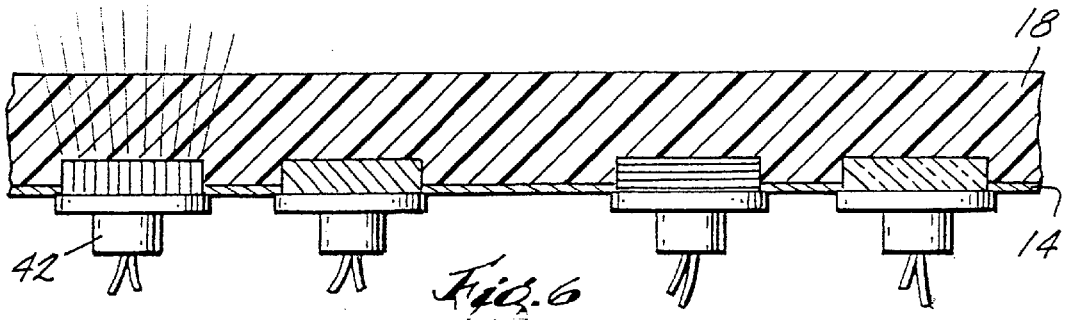
FIG. 6 is a view similar to FIG. 3 showing the panel of FIG. 5 after the panel has been turned over and the light sources are placed behind the wells.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in a various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

DETAILED DESCRIPTION OF THE PREFERRED EMBODIMENT

This invention provides a method of making and illuminate, multicolored pane 10, comprising the steps of fixing together a thin opaque layer 14 to a thicker clear layer 18 to form the panel 10, etching a well 22 into the opaque layer 14 of the panel so that all of the opaque material in the well 22 is removed, depositing a tinted material 26 into the well 22 to fill the well 22, etching a second well 30 into the opaque layer of the panel so that all of the opaque material in the well 30 is removed, and illuminating more than one of the wells from the opaque side of the panel 10.

More particularly, a control panel designer uses a variation of the prior art engraving method referred to above. In this method the designer begins with the two layer panel 10. The thicker layer 18 is clear, and the much thinner layer 14 is opaque. In the preferred embodiment, the opaque layer is black. Although various methods of obtaining a two layer panel 10 can be used, in the preferred embodiment, a conventional blended acrylic extruded sheet about an eight of an inch thick is used with the cap and core permanently fused together. In other embodiments, any etchable or removable material may be used for the opaque layer, and any clear material can be used for the other layer.

In the preferred embodiment, the designer then uses a CNC engraver and an electronic file to engrave the areas that are desired to be without color. In other embodiments, other means for producing wells in the opaque layer can be used. The engraving removes the black area of the panel approximately 0.03 inches deep. Part of the underlying clear layer 18 is also removed at this depth in order to insure all of the black layer 14 has been removed. The clear epoxy is then mixed with paint dye to create the colored translucent solution 26. The designer then fill's the engraved areas with the colored translucent material 26. The epoxy then hardens and remains in place in the well 22.

In the preferred embodiment, the designer would first etch the areas to be filled with a selected color. The etched areas are then filled with the selected solution to produce the desire color. Other areas are etched and similarly filled. Where only a white color is desired, the area are etched and then left unfilled. In other embodiments, a clear epoxy could be used to fill these etched areas.

With this method, each panel 10 can be custom made without tooling or template charges. The lead times are also short, due to the fact that no tooling or templates must be made.

The multicolored control panel 10 is then placed into a housing 34 in a cab 38, such as on a blasthole drill. Various switches and other elements (not shown) which the operator may need extend through openings (not shown) provided in the control panel 10. White lights 42 positioned in the housing then illuminate the etched areas. In the preferred embodiment, the lights 42 are adhered to the control panel. Thus, the clear engraved areas appear white, and light shining through the colored areas illuminate the desired color.

What is claimed is:

1. A method of making an illuminate, multicolored panel, comprising the steps of fixing together an opaque layer to a clear layer to form a panel, etching a well into the opaque layer of the panel, and depositing tinted translucent material into the well.

2. A method of making a panel according to claim 1, which includes the step of illuminating the tinted material from the opaque side of the panel.

3. A method of making a panel according to claim 1 wherein said clear layer is substantially thicker than said opaque layer.

4. A method of making an illuminate, multicolored panel, comprising the steps of fixing together an opaque layer and a clear layer which substantially thicker than said opaque layer to form a panel, etching a well into the opaque layer of the panel so that all of the opaque material in the well is removed, depositing tinted translucent epoxy into the well to fill the well, and illuminating the tinted translucent epoxy from the opaque side of the panel.

5. A method of making a panel according to claim 4 wherein multiple wells are etched into the opaque layer and more than one of the wells is illuminated.

6. A method of making an illuminate, multicolored panel, comprising the steps of fixing together an opaque layer and a clear layer substantially thicker than said opaque layer to form a panel, etching a well into the opaque layer of the panel so that all of the opaque material in the well is removed, depositing tinted translucent epoxy into the well to fill the well, etching a second well into the opaque layer of the panel so that all of the opaque material in the well is removed, and illuminating both of the wells from the opaque side of the panel.

* * * * *